US009500430B2

(12) United States Patent
Righi et al.

(10) Patent No.: US 9,500,430 B2
(45) Date of Patent: Nov. 22, 2016

(54) FIREARM WITH BARREL STATE VERIFICATION DEVICE

(71) Applicant: FABBRICA D'ARMI PIETRO BERETTA S.p.A., Gardone Val Trompia, Brescia (IT)

(72) Inventors: Eugenio Righi, Brescia (IT); Simone Dalola, Brescia (IT); Vittorio Ferrari, Brescia (IT)

(73) Assignee: FABBRICA D'ARMI PIETRO BERETTA S.p.A., Brescia (IT)

( * ) Notice: Subject to any disclaimer, the term of this patent is extended or adjusted under 35 U.S.C. 154(b) by 187 days.

(21) Appl. No.: 14/369,233

(22) PCT Filed: Mar. 25, 2013

(86) PCT No.: PCT/IB2013/052348
§ 371 (c)(1),
(2) Date: Jun. 27, 2014

(87) PCT Pub. No.: WO2013/144808
PCT Pub. Date: Oct. 3, 2013

(65) Prior Publication Data

US 2015/0000169 A1 Jan. 1, 2015

(30) Foreign Application Priority Data

Mar. 27, 2012 (IT) ..... BS2012A0044

(51) Int. Cl.

| | |
|---|---|
| ***G01L 7/20*** | (2006.01) |
| ***F41A 31/02*** | (2006.01) |
| ***F41A 17/14*** | (2006.01) |
| ***F41A 31/00*** | (2006.01) |
| ***F41A 17/00*** | (2006.01) |
| ***F41A 17/06*** | (2006.01) |

(52) U.S. Cl.
CPC ..... *F41A 31/02* (2013.01); *F41A 17/00* (2013.01); *F41A 17/063* (2013.01); *F41A 17/14* (2013.01); *F41A 31/00* (2013.01)

(58) Field of Classification Search
None
See application file for complete search history.

(56) References Cited

U.S. PATENT DOCUMENTS

| | | | | |
|---|---|---|---|---|
| 5,619,006 | A | 4/1997 | Maus | |
| 7,470,056 | B2 * | 12/2008 | Yuhas | F41A 31/02 374/119 |
| 2006/0075817 | A1 | 4/2006 | Yuhas | |
| 2014/0163664 | A1 * | 6/2014 | Goldsmith | A61B 17/00491 623/1.11 |
| 2015/0285628 | A1 * | 10/2015 | Hintz | G01V 5/0016 250/358.1 |

FOREIGN PATENT DOCUMENTS

| | | | |
|---|---|---|---|
| DE | 3925544 | A1 | 2/1991 |
| DE | 4318185 | A1 | 12/1994 |
| DE | 19737078 | A1 | 3/1999 |
| DE | 10204504 | A1 | 8/2003 |

OTHER PUBLICATIONS

International Preliminary Report on Patentability for International Application No. PCT/IB2013/052348, dated Jun. 2, 2014.

* cited by examiner

*Primary Examiner* — Andre Allen
(74) *Attorney, Agent, or Firm* — Meunier Carlin & Curfman LLC

(57) ABSTRACT

The invention is a. firearm (1) comprising a verification device (10) suitable for verifying and detecting an anomaly of the state of the barrel (2), such as the presence of partial or total occlusions or variations of cross-section. The device (10) comprises receiver means (200), on the firearm (1), suitable for detecting a detected signal (R) derivable from an emitted signal (E), influenced by said anomaly.

12 Claims, 3 Drawing Sheets

FIREARM WITH BARREL STATE VERIFICATION DEVICE

The present invention relates to a firearm having a verification device suitable for verifying and detecting an anomaly of the barrel state, such as the presence of occlusions and/or variations of cross-section. Specifically, assessing the presence of an occlusion inside the barrel of the firearm and/or its deformation proves extremely useful in that it enables the user to use the firearm in total safety.

In fact, the presence of an occlusion or a deformation of the barrel entails serious risks: from the incorrect emission of a shot to the explosion of the barrel itself.

In particular, it is quite frequent for a part of the exploded bullet to remain in the barrel after firing, or for the barrel to be occluded following an attempt to fire a bullet of the wrong dimensions compared to the dimensions allowed or ideal dimensions, or even that mud, gravel or snow should enter the barrel.

In the prior art verification systems of the presence of occlusions inside the barrel of a firearm are known which have innumerable disadvantages. In fact in the first place the known systems are generally of the manual type; said systems oblige the user to perform a series of operations aimed at verifying the presence of occlusions inside the barrel. For example, some systems of the prior art consist of rods suitable for being inserted in the barrel of the firearm; as a result of the presence of an occlusion their movement inside the barrel is prevented or permitted; the possibility of being able to move said systems or not inside the barrel is the feedback which the user receives thanks to which he may assess whether there is an occlusion and/or variation of cross-section of said barrel or not. Or, systems which need to be inserted in the barrel are also present, for example inside the area where the cartridges are loaded; in such case if the user is able to see them looking through the barrel of the firearm, in some cases through the muzzle, this means the presence of an occlusion can be ruled out. In some embodiments, said systems are suitable for producing a visual luminous signal so as to make the inspection operation simpler and clearer. Or again, in some further embodiments, openings are made on the firearm itself suitable for permitting a visual inspection of the inside thereof.

Each of said systems thus obliges the user to perform a series of operations and/or draw an empirical conclusion relative to the presence or not of the problems as mentioned above.

In addition, it is to be noted that such systems do not prove particularly efficacious in the case in which there are no occlusions but there is a change in the cross-section of the barrel, for example following impact. In the prior art verification of the barrel state is thus left to the user to perform if desired and to the user's ability to perform such step, thus giving rise to the possibility of situations of risk arising. The purpose of the present invention is to make a firearm comprising a verification device suitable for performing simple and immediate verification and in some cases annulling, preferably reducing to zero, situations of risk. Such purpose is achieved by a firearm according to the claims, and by a verification method according to the claims. The firearm which the present invention relates to provides a verification device which permits a simple, and in some embodiments automatic, verification of the barrel state. Further advantages and embodiments, both relative to the firearm and to the verification method, will be clear from the claims. Moreover, the characteristics and advantages of the verification device will be evident from the description given below, made by way of a non-limiting example, with reference to the attached drawings, wherein:

FIG. 2 is a block diagram showing the verification device comprised in the firearm which the present invention relates to;

Figure 1:
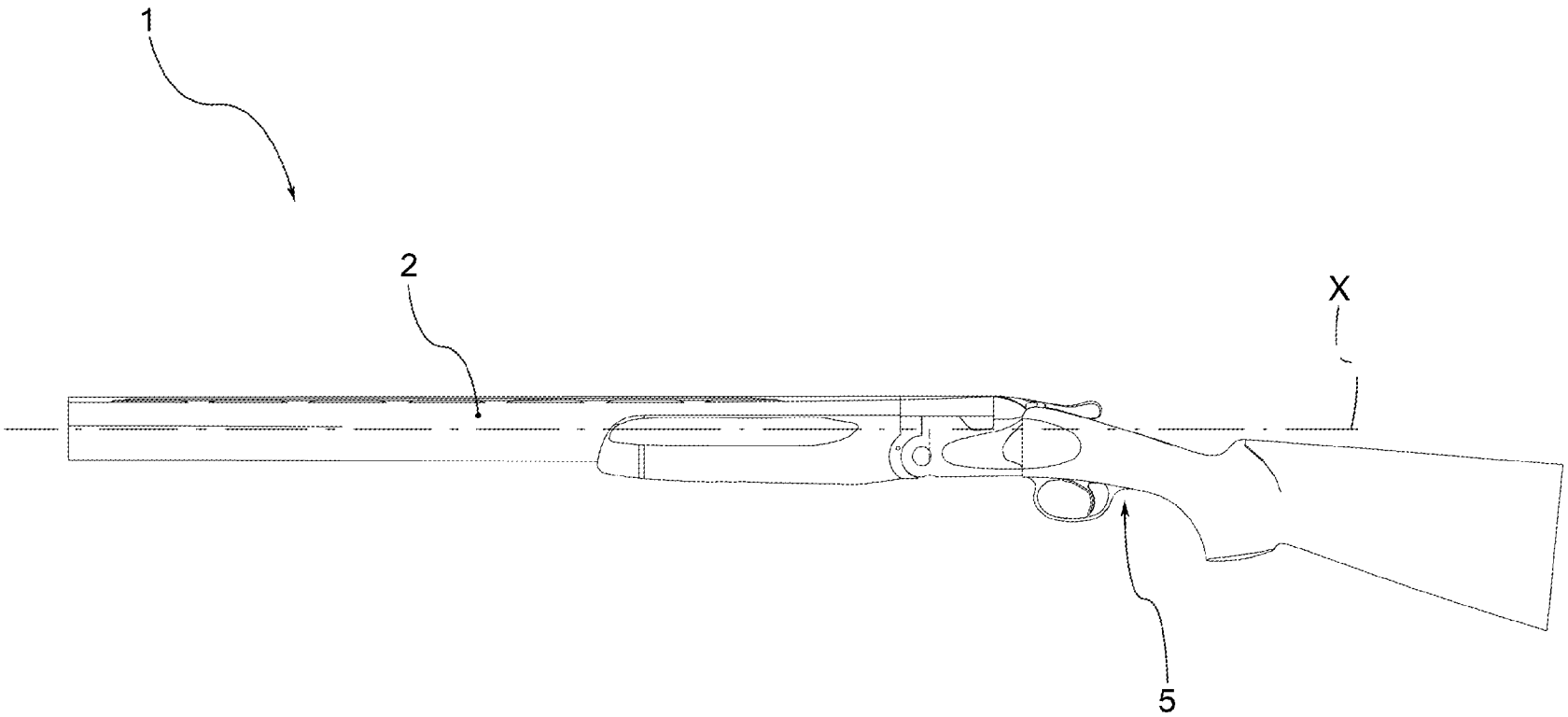
FIG. 1 shows a generic firearm such as that which the present invention relates to, comprising at least part of the verification device.
Figure 2:
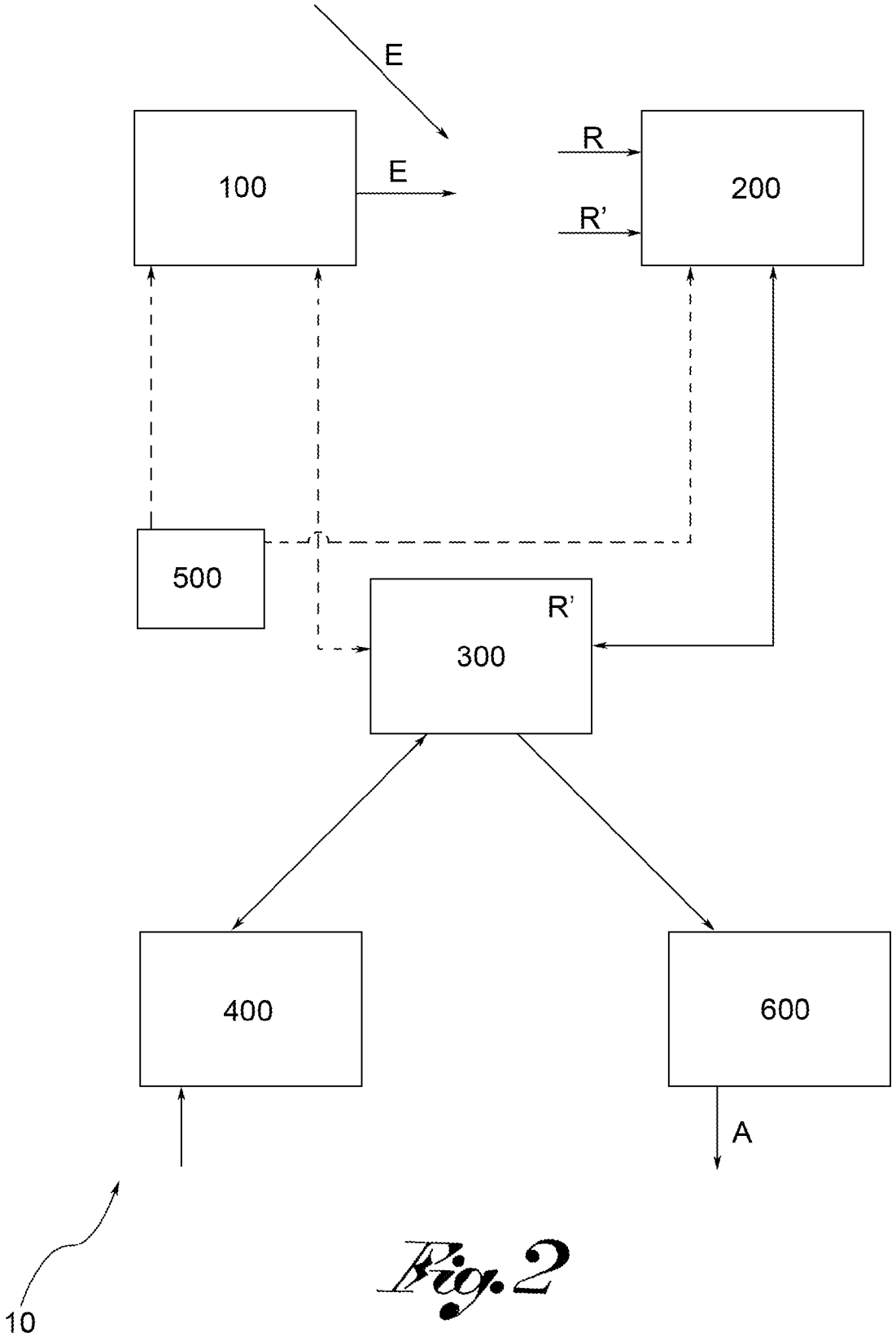
Figure 3A:
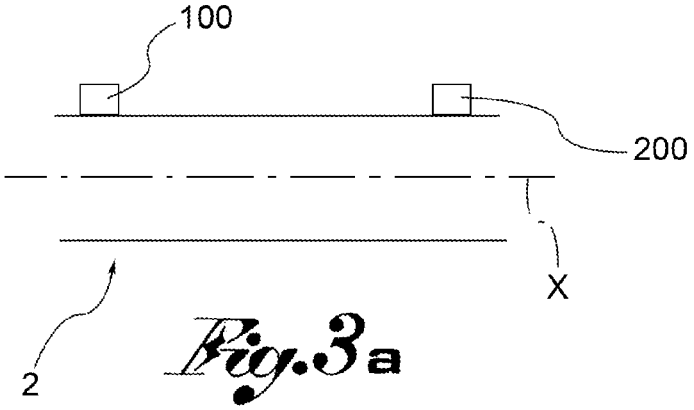
Figure 3B:
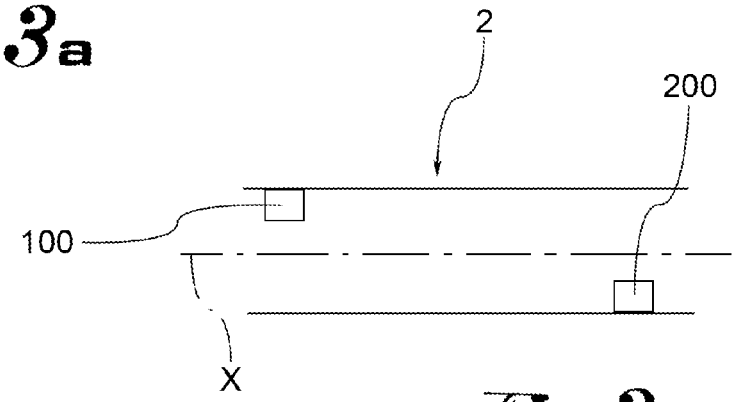
Figure 4A:
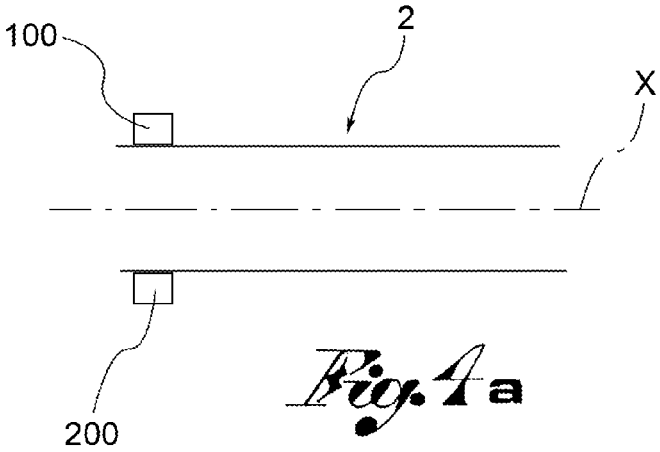
Figure 4B:
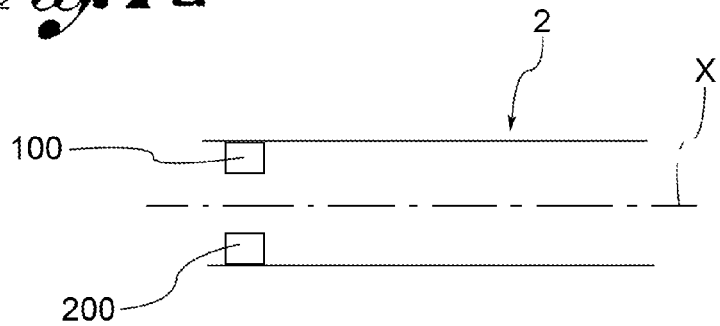

FIGS. 3*a* and 3*b*, and 4*a* and 4*b*, show schematised diagrams illustrating a portion of the barrel, and the different positioning of some components of the verification device; FIGS. 3*a* and 4*a* show said components acting on the barrel, while FIGS. 3*b* and 4*b* show said components acting in the barrel; FIGS. 3*a* and 3*b* show said components positioned distanced from each other, while FIGS. 4*a* and 4*b* show said components positioned substantially next to each other.

With reference to the appended drawings, reference numeral 1 globally denotes a firearm; the firearm 1 comprises a main body 5 and a barrel 2, which extends starting from said main body 5, preferably along the barrel axis X-X. The firearm 1 further comprises verification device 10, suitable for verifying and detecting the presence of anomalies of the state of the barrel 2, such as partial or total occlusions or variations of cross-section.

In particular, the verification device 10 is in fact suitable for verifying that the barrel 2 is in a predefined configuration, that is to say in an optimal state, in other words ready for safe use.

Preferably, the firearm 1 comprises at least one barrel 2, for example a single barrel but in some embodiments the firearm 1 comprises a plurality of barrels 2, for example on top of or next to each other. In a preferred embodiment, the firearm 1 which the present invention relates to is a rifle. The type of rifle varies depending on the type of barrels 2 it comprises. In any case the firearm 1 which the present invention relates to is not limited to the type of barrel 2 or to the firing mode, automatic or manual. Specifically, the main body 5 comprises a firing device, for example suitable for being triggered by means of at least one trigger fitted in a moveable manner (for example rotatable or translatable) on the main body, and a hammer which can be operated by means of such trigger acting on the firing pin, or in which the trigger acts directly on the firing pin, or even with an electronic trigger. In a preferred embodiment, the verification device 10 is suitable for verifying the presence of an anomaly of the state of the barrel 2, such as the presence of a partial or total occlusion, or variation of its cross-section, detecting inside or on said barrel, for example on the structure thereof, a physical magnitude which is suitable for being influenced by the presence of said occlusion or said variation of cross-section of the firearm. In a preferred embodiment, the verification device is also suitable for producing inside the barrel 2 or on the barrel 2, for example on the structure thereof, said physical magnitude to be detected.

In particular, to achieve said purpose, the verification device 10 comprises receiver means 200, preferably located on the firearm 1. In the further embodiment, in which the verification device is also suitable for producing the physical magnitude to be measured the verification device 10 comprises emitter means 100, preferably located on the firearm 1.

Preferably, the receiver means 200 are suitable for detecting a detected signal R suitable for being derived from an emitted signal E, suitable for being influenced by said anomaly.

In one embodiment, said emitted signal E is a characteristic of the environment which the firearm 1 is placed in. For example, the emitted signal E is the sunlight or environmental background noise, or any characteristic measurable in the barrel 2 or on the barrel and suitable for being influenced by the presence of an occlusion and/or a variation of cross-section.

Consequently the receiver means 200 are suitable for detecting a detected signal R which derives from the emitted signal E.

In further embodiments, instead the emitted signal E is produced by the emitter means 100, suitable for producing it inside the barrel 2 or on the barrel 2.

In a preferred embodiment, the verification device 10 comprises control means 300, operatively connected to the receiver means 200 and/or to the emitter means 100.

In an embodiment variant, the verification device 10 comprises control means 300, operatively connected to the receiver means 200 and, if necessary to the emitter means 100 if present.

The control means 300 are suitable for detecting and assessing a possible variation of the detected signal R from an expected signal R', deriving from, the emitted signal E in predefined conditions of the firearm 1; said variation is, in particular, due to the presence of said anomaly such as the presence of an occlusion in the barrel 2 or a variation of its cross-section Specifically, the expected signal R' is a function of the emitted signal E and of predefined conditions and specifically of the optimal conditions in which the firearm 1 is suitable for being used in complete safety. In other words, the predefined conditions are those in which the firearm 1, and in particular the barrel 2, do not present anomalies, that is to say do not have internal occlusions and have not undergone variations of cross-section. In yet other words, the predefined conditions of the firearm 1 are those in which it is suitable for firing optimally.

In a preferred embodiment, the verification device comprises command means 500 suitable for commanding and operating the receiver means 200 in such a way that the control means 300 compare the detected signal R to an expected signal R'. In a further preferred embodiment, the verification device 10 comprises command means 500 suitable for commanding and operating the emitter means 100 to emit the emitted signal E. Specifically, the command means 500 are operable by the user directly on the firearm 1 or remotely. The command means 500 are thus suitable in some embodiments to be housed on the firearm 1.

In other embodiments, instead, the command means are positioned externally to the firearm 1. For example, in a preferred embodiment, the command means 500 are a logical unit, or a processor, or a calculator external to the firearm 1. Preferably, they are positioned on an accessory suitable for being carried by the user for example an accessory attachable to the user's belt. In a preferred embodiment, the control means 300 are in turn housed on the firearm 1. In other embodiments, the control means 300 are only partially housed on the firearm 1, comprising firearm control elements, positioned on the firearm 1, and remote control elements, positioned externally to the firearm 1; for example the remote control elements are in an external accessory, for example suitable for being carried by the user, preferably attachable to the user's belt. In a preferred embodiment, the control means 300 and/or the receiver means 200 detect and measure said variation depending on the geometrical and dimensional characteristics of the firearm 1, for example of the barrel 2, assessing or not the predefined conditions of the firearm 1 and thus identifying the values of the expected signal R'. Specifically, in fact the control means 300 and/or the receiver means 200 are suitable for performing the respective measurements depending on the geometrical characteristics of the barrel 2, for example of the diameter of the barrel 2 or of its thickness or of the material, depending on whether the emitted signal E is emitted and must therefore be measured, inside the barrel or on said barrel 2. Moreover, so as not to be influenced by the environmental conditions which the firearm 1 is used in, the verification device 10 is suitable for detecting said conditions and can be reconfigured according to said conditions, for example in addition to the application in which said environmental conditions are the emitted signal E itself. Specifically, the device 10 comprises acquisition means 400 suitable for acquiring data deriving from the environmental conditions. Said acquisition means 400 are operatively connected to the control means 300 and/or the receiver means 200 and/or the emitter means 100, preferably operatively connected to the control means 300. This way the receiver means 200 and/or the emitter means 100 are reconfigured depending on what is acquired by the acquisition means 400, so as not to be influenced in receiving the detected signal R and/or in the emission of the emitted signal E by environmental conditions, varying for example the expected signal R' to better compare it to the detected signal R. In particular, said reconfiguration can be performed by the verification device 10 automatically by means of the control means 300. In further embodiments, said configuration is performed manually by the user using the control means 300. In a preferred embodiment, the verification device further comprises signalling means 600 operatively connected to the control means 300 and/or to the receiver means 200 in such a way that if a variation of the detected signal R compared to the expected signal R' is detected, they signal said detection to the user and/or prevent use of the firearm 1. Preferably, the signalling means 600 are suitable for interacting with the user by means of a warning signal A so as to warn him of the presence of an occlusion in the barrel 2 or of a variation of the cross-section thereof. In a preferred embodiment, the warning signal A is of the acoustic type. In a further embodiment, the warning signal A is of the luminous type. Preferably the signalling means 600 are positioned on the firearm 1. In further embodiments, the signalling means 600 are instead positioned externally to the firearm 1, for example in accessories suitable for positioning near the user, for example on an accessory suitable for being carried by the user preferably attachable to the user's belt. In a preferred embodiment, the firearm 1 checks the presence of anomalies of the barrel 2 by means of the verification device 10, such as the presence of partial or total occlusions or variations of cross-section, according to a verification method comprising the steps of:

detecting, by means of receiver means 200, a detected signal R derived from the emitted signal E in turn suitable for being influenced by the presence of said anomaly.

Moreover, said method preferably also comprises the step of:

detecting and assessing a possible variation of the detected signal R from an expected signal R', deriving from the emitted signal E, due to the presence of said anomaly.

In addition said method preferably comprises the step of:

signalling said variation to the user of the firearm 1 by sending a luminous and/or acoustic warning signal A.

Alternatively or in addition to said previous step, the verification method preferably also comprises the step of:

preventing the functioning of the firearm 1 following detection of said variation.

Moreover, the verification method also comprises the step of:

emitting, by means of emitter means 100, an emitted signal E inside or on the barrel 2.

In a preferred embodiment, the verification device 10 is suitable for verifying the presence of an anomaly of the state of the barrel 2, such as the presence of an occlusion, or variation of its cross-section, by emitting a signal of the acoustic type in the barrel 2. Specifically, in said embodiment, the emitter means 100 comprise a loudspeaker suitable for producing waves, preferably stationary, inside the barrel 2 which has several resonance frequencies and consequently acts as an amplifier; for example the emitted signal E is of the acoustic type.

Specifically, the barrel 2, given its structure has several predefined resonance frequencies and thus acts as an amplifier in a predefined manner, depending on its geometrical and dimensional characteristics: length, diameter and thickness, type of material.

In said embodiment, the receiver means 200 comprise an acoustic type detector, such as a microphone, suitable for picking up a detected signal R of the acoustic type.

In particular, the emitter means 100 and the receiver means 200 are suitable for being positioned in the barrel 2 in any position. Preferably, the emitter means 100 and the receiver means 200 are positioned near each other, for example near the firing zone, or the muzzle, or even inside the extension of the barrel 2.

This way, in a configuration of use of the firearm 1, in which the firearm 1 is ready to be used and thus to fire, the emitted signal E is propagated according to a frequency response which has predefined resonance frequencies and the detected signal R is an acoustic signal which is a function of the emitted signal E and of said resonance frequencies; in particular, in predefined conditions of the firearm 1 the detected signal R is the same as the expected signal R'.

If there is an occlusion in the barrel 2 however the frequency response of said barrel 2, in particular the resonance frequencies, vary, thus making the detected signal R vary.

In this case the detected signal R detects an acoustic signal which is a function of the emitted signal E but propagated according to a frequency response with different resonance frequencies from those predefined as characteristic of the firearm; specifically, a variation between the detected signal R and expected signal R' is thus detected by the control means 300; at this point the signalling means 600 warn the user of the presence of the occlusion.

It is to be noted moreover that depending on the configurations of the firearm 1 the predefined resonance frequencies of the firearm are variable; in other words, for example in the case in which the firearm 1 is a rifle with a tilting barrel, the barrel 2 is suitable to assume various configurations, barrel open, barrel closed, with or without a bullet in the barrel and so forth. Each of said configurations has its own specific resonance frequencies. However, the presence of an occlusion varies each of said specific resonance frequencies.

In particular, depending on the configuration assumed, the control means 300 are suitable for detecting said change and thus reconfiguring the receiver means 200.

In the same way the control means 300 are suitable for reconfiguring the receiver means 200 depending on what is acquired by the acquisition means 400, for example a background noise, so as to prevent acoustic interference with the emitted signal E.

Preferably, to prevent said type of interference the emitted signal E is of the ultrasonic type.

Similarly, the detected signal R will also vary in relation to the optimal condition in the case in which the barrel 2 undergoes a change in shape, for example due to a change of cross-section.

In a further preferred embodiment variant, the verification device 10 is suitable for verifying the presence of an anomaly of the state of the barrel 2, such as the presence of an occlusion, or variation of its cross-section, by emitting a mechanical signal on the barrel 2, in particular on the structure of the barrel 2. Specifically, in said embodiment, the emitter means 100 comprise a transducer suitable for producing mechanical impulses and vibrations on the barrel 2, the emitted signal E thus being of the mechanical type.

Specifically, the barrel 2, given its structure has predefined mechanical resonance frequencies depending on its geometrical and dimensional characteristics: length, diameter and thickness, type of material.

For example in said embodiment, the receiver means 200 preferably comprise one or more piezoelectric transducers, all together suitable for picking up a detected signal R of the mechanical type.

In particular, the emitter means 100 and the receiver means 200 are suitable for being positioned at the ends of the barrel 2. Preferably, the emitter means 100 are positioned near the firing zone inside the firearm 1, and the receiver means 200 are suitable for being positioned near the muzzle of the firearm 1, or vice versa.

This way, in the configuration of use of the firearm 1, in which the firearm 1 is ready to be used and thus to fire, the detected signal R detects a mechanical signal which is a function of the emitted signal E and of said mechanical, resonance frequencies; in particular, in predefined conditions of the firearm 1 the detected signal is the same as the expected signal R'.

If however there is an occlusion in the barrel 2 between the emitters 100 and the receiver means 200 the emitted signal E is absorbed or varied. Moreover, the presence of an occlusion varies the frequency response of the barrel 2 itself and, in particular, the frequency resonance.

In this case the detected signal R detects a signal, a vibration, function of the emitted signal E, propagated according to a frequency response with different resonance frequencies from those predefined by the characteristics of the firearm 1; specifically, a variation between the detected signal R and expected signal R' is thus detected by the control means 300; at this point the signalling means 600 warn the user of the presence of the occlusion.

Similarly, the detected signal R is also different from the expected signal R' in the case in which the barrel 2 undergoes a change in shape, for example due to a change of cross-section, inasmuch as the frequency response and in particular the resonance frequency is varied.

In an embodiment variant, the verification device 10 is suitable for verifying the presence of an anomaly of the state of the barrel 2, such as the presence of an occlusion, or variation of its cross-section, by emitting a signal of the acoustic type in the barrel 2, making use of the echo principles and sonar effect. Specifically, in said embodiment, the emitter means 100 comprise a transducer suitable for producing acoustic waves inside the barrel 2, for example the emitted signal E is of the acoustic type.

Specifically, the barrel 2, given its structure reflects the emitted signal E in a predefined manner depending on its geometrical and dimensional characteristics: length, diameter and thickness, type of material. In fact, in said embodiment also, predefined conditions of the barrel 2 are identified according to which this has predefined characteristics of propagation and response thus permitting the transmission of the emitted signal E inside the barrel 2.

In said embodiment, the receiver means 200 comprise a sensor, suitable for detecting a detected signal R of the acoustic type and specifically suitable for detecting the reflected acoustic signal (echo).

In particular, the emitter means 100 and the receiver means 200 are suitable for being positioned in the barrel 2 in any position. Preferably, the emitter means 100 and the receiver means 200 are positioned near each other, for example near the firing zone, or the muzzle, or even inside the extension of the barrel 2.

This way, in the configuration of use of the firearm 1, in which the firearm 1 is ready to be used and thus to fire, the emitted signal E will be reflected in a predefined manner by the barrel 2, according to its propagation and response characteristics which occur at predefined times.

The detected signal R thus has characteristics which are a function of the emitted signal E and of said reflection modes.

If however there is an occlusion in the barrel 2 the emitted signal E is reflected by the barrel and by said occlusion in a different manner, in different times and thus the detected signal R varies form the expected signal R'.

Specifically, a variation between the detected signal R and expected signal R' is thus detected by the control means 300; at this point the signalling means 600 warn the user of the presence of the occlusion.

It is to be noted moreover that depending on the configurations of the firearm 1 the reflection modes of the barrel are variable; in other words, for example in the case in which the firearm 1 is a rifle with a tilting barrel, the barrel 2 is suitable to assume various configurations, barrel open, barrel closed, with or without a bullet in the barrel and so forth. Each of said configurations has its propagation and response characteristics and its own specific reflection mode and relative timescale. However, the presence of an occlusion varies each of said reflection modes.

Specifically, depending on the configuration assumed, the control means 300 are suitable for detecting said change and thus reconfiguring the receiver means 200 so that they assess the modes according to which the variation occurred.

In the same way, the emitted signal E is also differently reflected in the case in which the barrel 2 undergoes a variation of shape, for example due to a change of cross-section, and thus the detected signal R is varied compared to the predefined conditions giving rise to the expected signal R'.

In yet a further embodiment, the verification device 10 is suitable for verifying the presence of an anomaly of the state of the barrel, such as the presence of an occlusion, or the variation of its cross-section, by emitting a signal of the thermal type on the barrel 2, and in particular on the structure thereof. Specifically, in said embodiment, the emitter means 100 comprise a heating element suitable for producing thermal impulses on the barrel 2, the emitted signal E thus being of the thermal type.

Specifically, the barrel 2, given its structure has a thermal impedance depending on its geometrical and dimensional characteristics: length, diameter and thickness, type of material.

In said embodiment, the receiver means 200 comprise a temperature sensor, suitable for detecting a detected signal R of the thermal type.

In particular, the emitter means 100 and the receiver means 200 are suitable for being positioned at the ends of the barrel 2. Preferably, the emitter means 100 are positioned near the firing zone inside the firearm 1, and the receiver means 200 are suitable for being positioned near the muzzle of the firearm 1, or vice versa.

This way, in a configuration of use of the firearm 1, in which the firearm 1 is ready to be used and thus to fire, the emitted signal E is propagated in a predefined manner in the barrel 2 and the detected signal R detected as a function of the emitted signal E and as a function of said thermal impedance, is the expected signal R'.

In addition, the detected signal R is received starting from the emitted signal E according to a number of time intervals.

The modification of the barrel state, that is the presence of an occlusion or change in cross section thereof makes said thermal impedance vary, this way the detected signal R will differ from the expected signal R', for example it will be received according to different time intervals from those relative to the expected signal R'.

In other words, if an occlusion is positioned between the emitter means 100 and the receiver means 200 the emitted signal E is absorbed or varied. Specifically, the presence of an occlusion varies the thermal impedance of the barrel 2, and thus the detected signal R will vary from the expected signal.

In fact, in this case the detected signal R, function of the emitted signal E, is propagated differently from the optimal manner; specifically, a variation between the detected signal R and expected signal R' is thus detected by the control means 300; at this point the signalling means 600 warn the user of the presence of the occlusion.

Similarly, the detected signal R is also different from the expected signal R' in the case in which the barrel 2 undergoes a change in shape, for example due to a change of cross-section.

In a further embodiment variant, the verification device 10 is suitable for verifying the presence of an anomaly of the state of the barrel, such as the presence of an occlusion, or variation of its cross-section, by emitting a signal of the acoustic-mechanical type by means of guided waves on the barrel 2. Specifically, in said embodiment, the emitter means 100 comprise an actuator suitable for producing guided waves on the barrel 2, for example the emitted signal E is of the acoustic type.

Specifically, the barrel 2, given its structure has a predefined frequency response, and in particular resonance frequencies, depending on its geometrical and dimensional characteristics: length, diameter and thickness, type of material.

In said embodiment, the receiver means 200 comprise an acoustic type detector, such as a microphone; preferably said microphone is suitable for picking up a detected signal R of the acoustic type for example ultrasonic.

In particular, the emitter means 100 and the receiver means 200 are suitable for being positioned at the ends of the barrel 2. Preferably, the emitter means 100 are positioned near the firing zone inside the firearm 1, and the receiver means 200 are suitable for being positioned near the muzzle of the firearm 1, or vice versa.

This way, in the configuration of use of the firearm 1, in which the firearm 1 is ready to be used and thus to fire; the emitted signal E is propagated according to a predefined frequency response of the barrel 2 with, in particular predefined resonance frequencies and the detected signal R detects an acoustic signal which is a function of the emitted signal E and of said frequency response and resonance frequencies.

If an occlusion is positioned between the emitter means 100 and the receiver means 200 however, the emitted signal E is absorbed or varied. Specifically, the presence of an occlusion varies the acoustic impedance of the barrel 2, varying the frequency response and its parameters, among which the resonance frequency.

In this case the detected signal R detects an acoustic signal which is a function of the emitted signal E but propagated according to a frequency response with, in particular, different resonance frequencies from those typically caused by the characteristics of the firearm; specifically, a variation between the detected signal R and expected signal R' is thus detected by the control means 300; at this point the signalling means 600 warn the user of the presence of the occlusion.

Similarly, the detected signal R is also different from the expected signal R' in the case in which the barrel 2 undergoes a change in shape, for example due to a change of cross-section.

In a further embodiment, the verification device 10 is suitable for verifying the presence of an anomaly of the state of the barrel, such as the presence of an occlusion, or variation of its cross-section, by emitting a signal of the optical type inside the barrel 2. Specifically, in said embodiment, the emitter means 100 comprise a light emitter, the emitted signal E thus being of the luminous type.

Preferably, the emitter is an LED source, which emits a light inside the barrel 2, or again the emitter is suitable for emitting, inside the barrel 2, for example an infra red source.

In said embodiment, the receiver means 200 comprise an optical type detector, such as a photodiode, suitable for detecting the intensity of a detected signal R of the luminous type.

In said embodiment, the emitter means 100 and the receiver means 200 are suitable for being positioned at the ends of the barrel 2. Preferably, the emitter means 100 are positioned near the firing zone inside the firearm 1, and the receiver means 200 are suitable for being positioned near the muzzle of the firearm 1, or vice versa.

This way, in the configuration of use of the firearm 1, in which the firearm 1 is ready to be used and thus to fire, the emitted signal E and the detected signal R have a specific relation which identifies the reference situation. In other words, in said embodiment, the expected signal R' is the same as the detected signal R and thus the same as the emitted signal E not influenced by any anomaly; the receiver means 200 detect the emission of the emitter means 100 when it fully corresponds to said specific relation.

If an occlusion is positioned between the emitter means 100 and the receiver means 200 however the signal E emitted by the former is blocked, absorbed or varied.

In this case the detected signal R is different from the expected signal R', and a variation between the detected signal R and expected signal R' is thus detected by the control means 300; at this point the signalling means 600 warn the user of the presence of the occlusion.

Similarly, the detected signal R is also different from the expected signal R' in the case in which the barrel 2 undergoes a change of cross-section.

Innovatively, the firearm which the present invention relates to is suitable for verifying the presence of an occlusion in the barrel 2, or a variation of the cross-section thereof, in an automatic manner, preventing the user from having to perform a series of operations in person. Advantageously the verification is automatic and thus at any time the user is warned of the presence of a problem which could put his safety at risk at the moment of firing.

Advantageously by using the command means, the user can check the barrel state immediately and instantaneously. According to one advantageous aspect, the user is thus encouraged to perform such verification, given that he does not have to perform any operation in person except, perhaps, that of activating the verification device.

Advantageously the verification device is suitable for verifying and detecting the presence of partial or total occlusions.

Advantageously the verification device is suitable for assessing the barrel state in its entirety.

Advantageously the electronics needed for the functioning of the device are not particularly complicated.

According to one advantageous aspect, some components of the device may be positioned on the firearm and others remotely, or the verification device may be positioned entirely on the firearm.

Advantageously, in the case in which some components are positioned remotely from those positioned on the firearm, the various components are suitable for reciprocally communicating by means of data transmission, for example wireless, Bluetooth, infrared, further transmission protocols or the like.

According to a further advantageous aspect, in the embodiment in which the verification device is suitable for performing its verification by emitting an acoustic signal the situation of the barrel is verified in every configuration thereof: open, closed, with or without a cartridge inside it.

Advantageously in the embodiment in which the verification device is suitable for performing its verification by emitting a signal in the structure of the barrel the emitter means and receiver means are suitable for being positioned outside said barrel.

Advantageously emitter means and receiver means can be printed and/or glued to the barrel, for example using photolitho and/or silkscreen printing techniques.

Advantageously the embodiments of the verification device are suitable for verifying the presence of a partial or total occlusion, or variation of the cross-section of the barrel, for example caused by impact or due to a rupture or crack or split.

Advantageously, in the embodiment in which the verification device is suitable for performing its verification by solely detecting a signal, the verification device is suitable for exploiting environmental characteristics so as to identify the correspondence of the signal detected with the expected signal. According to an advantageous aspect, the verification device comprises a small number of components, suitable moreover to reconfigure themselves as said environmental conditions change, thereby identifying the expected signal corresponding to the relative environmental conditions.

Advantageously the verification device is also suitable for taking into consideration the environmental conditions in the embodiment comprising the emitter means so as to best configure the various components so that they are not influenced in their functioning by said environmental conditions.

Advantageously the verification device is suitable for taking into consideration environmental conditions such as for example temperature and/or humidity and/or background noise.

A person skilled in the art may make variations to the embodiments of the firearm described above or replace elements with others functionally equivalent so as to satisfy specific requirements.

Such variations are also contained within the sphere of protection as defined by the following claims.

Moreover, each of the variants described as belonging to a possible embodiment may be realised independently of the other variants described.

The invention claimed is:

1. A firearm comprising a main body and a barrel, wherein said barrel extends starting from said main body, and a verification device suitable for verifying and detecting the presence of partial or total occlusions in the barrel or variations of cross-section, such constituting an anomaly of the barrel status, wherein the device comprises receiver means, on the firearm, suitable for detecting a detected signal derivable from an emitted signal, influenced by said anomaly;

wherein the verification device comprises control means, operatively connected to the receiver means and/or to emitter means suitable for producing the emitted signal, wherein the control means are suitable for detecting and measuring a variation of the detected signal from an expected signal, deriving from the emitted signal in predefined conditions of the firearm, due to the presence of said anomaly;

wherein the firearm further comprises signalling means, on the firearm, operatively connected to the control means in such a way that, in a configuration in which said control means detect a variation of the detected signal compared to the expected signal, the signalling means signal said detection to the user and/or prevent use of the firearm.

2. A firearm according to claim 1, wherein the control means are at least partially on the firearm.

3. A firearm according to claim 2, wherein the control means and/or the receiver means detect and measure said variation depending on the geometrical and dimensional characteristics of the firearm, for example of the barrel.

4. A firearm according to claim 1, wherein the verification device further comprises acquisition means suitable for acquiring data deriving from the environmental conditions of the environment which the firearm is placed in, operatively connected to the control means and/or the receiver means and/or the emitter means.

5. A firearm according to claim 1, wherein the control means are suitable for automatically or manually reconfiguring the receiver means and/or the emitter means following a variation of the environmental conditions, depending on what is picked up by the acquisition means.

6. A firearm according to claim 1, wherein the verification device comprises command means, suitable for commanding the emitter means to emit said emitted signal.

7. A firearm according to claim 6, wherein the command means are operable by the user directly on the firearm or remotely, for example by means of a logical unit.

8. A firearm according to claim 1, wherein the emitter means are suitable for emitting an emitted signal of an acoustic type, such as an acoustic wave, inside the barrel.

9. A firearm according to claim 1, wherein the emitter means are suitable for emitting an emitted signal of a mechanical type, such as a vibration, on the barrel.

10. A firearm according to claim 1, wherein the signalling means are suitable for interacting with the user by means of a warning signal of the luminous and/or acoustic type.

11. A method for verifying the presence of partial or total occlusions or variations of cross-section in or on the barrel of a firearm, such constituting an anomaly of the state of said barrel by means of a verification device, comprising the steps of:

detecting, by means of receiver means, a detected signal derived from an emitted signal influenced by said anomaly;

detecting and assessing a possible variation of the detected signal from an expected signal, deriving from the emitted signal in predefined conditions of the firearm, due to the presence of said anomaly; and signalling said variation to the user of the firearm by sending a luminous and/or acoustic warning signal; and preventing the functioning of the firearm following detection of said variation.

12. A verification method according to claim 11, further comprising the step of emitting, by means of emitter means, said emitted signal inside or on the barrel.

* * * * *